US008188642B2

(12) United States Patent
Ishida et al.

(10) Patent No.: US 8,188,642 B2
(45) Date of Patent: May 29, 2012

(54) SPARK PLUG FOR INTERNAL COMBUSTION ENGINE

(75) Inventors: Kenji Ishida, Aichi (JP); Hiroaki Kuki, Aichi (JP); Yuichi Yamada, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 191 days.

(21) Appl. No.: 12/452,696

(22) PCT Filed: Jul. 29, 2008

(86) PCT No.: PCT/JP2008/063549

§ 371 (c)(1),
(2), (4) Date: Jan. 15, 2010

(87) PCT Pub. No.: WO2009/017101

PCT Pub. Date: Feb. 5, 2009

(65) Prior Publication Data

US 2010/0133978 A1 Jun. 3, 2010

(30) Foreign Application Priority Data

Aug. 2, 2007 (JP) ..... 2007-202054

(51) Int. Cl.
*H01T 13/02* (2006.01)
*H01T 13/20* (2006.01)

(52) U.S. Cl. ..... 313/143; 313/118

(58) Field of Classification Search ..... 313/143, 313/141, 118; 123/169 R
See application file for complete search history.

(56) References Cited

U.S. PATENT DOCUMENTS

| | | | | |
|---|---|---|---|---|
| 5,831,377 | A * | 11/1998 | Matsubara et al. | 313/141 |
| 6,147,441 | A | 11/2000 | Osamura | 313/141 |
| 2002/0140333 | A1 | 10/2002 | Kato et al. | 313/143 |
| 2007/0126330 | A1 | 6/2007 | Kuki et al. | 313/143 |

FOREIGN PATENT DOCUMENTS

| | | |
|---|---|---|
| EP | 1 220 396 A1 | 7/2002 |
| JP | 6333664 | 12/1994 |

* cited by examiner

*Primary Examiner* — Karabi Guharay
(74) *Attorney, Agent, or Firm* — Kusner & Jaffe

(57) ABSTRACT

A spark plug 1 includes an insulator 2, a metal shell 3, a center electrode 5 and a ground electrode 27. A spark discharge gap 33 is formed between a front end portion 28 of the center electrode 5 and the ground electrode 27. The metal shell 3 has a through hole 29 therein and a metal convex portion 21 inwardly radially projecting in the through hole 29. The metal convex portion 21 includes a convex rearward face 30, a convex inner circumferential face 31 and a convex forward face 32. The through hole 29 has an inner diameter A (mm) at a front end side inner circumferential face 40, which is located at the front end side with respect to the convex forward face 32. The insulator 2 is inserted in the through hole 29 and has a first insulator taper portion 14, a second insulator taper portion 36 and a base 37 between the taper portions. The present invention satisfies the following representations: $G \leqq (A-B)/2$; $A \geqq 7.3$; and $2 \leqq XX \leqq 4$, where "B" (mm) is an outer diameter of a border K between an insulator front end portion 38 and the second insulator taper portion 36, where "G" (mm) is a distance of a spark discharge gap 33, and where "XX" (mm) is a length from a very-end portion FF of the convex inner circumferential face 31 to the border K in the axial C1 direction.

5 Claims, 5 Drawing Sheets

SPARK PLUG FOR INTERNAL COMBUSTION ENGINE

FIELD OF THE INVENTION

The present invention relates to a spark plug used for internal combustion engines.

BACKGROUND OF THE INVENTION

A spark plug used for internal combustion engines is mounted on an internal combustion engine so as to ignite an air-fuel mixture. Generally, a spark plug is composed of an insulator having an axial bore, a center electrode inserted in the axial bore, a metal shell disposed on an outer circumference of the insulator and a ground electrode provided at a front end face of the metal shell and forming a spark discharge gap with the center electrode. Generally, when the metal shell and the insulator are assembled, a metal shell taper portion provided on an inner circumferential face of the metal shell and an insulator taper portion provided on an outer circumferential face of the insulator are fixed together through a metal plate packing.

In a combustion chamber, carbon is produced due to an incomplete combustion of air-fuel mixture or the like. The carbon is accumulated on a surface of a part of the insulator (an insulator nose) that is exposed to the air-fuel mixture or combustion gas. When a certain amount of carbon is accumulated and covers on the surface of the insulator nose, electric current leaks from the center electrode to the metal shell through the carbon deposited on the insulator nose, whereby a normal spark discharge in the spark discharge gap tends to be interrupted.

In order to prevent this problem, it is known to extend the insulator nose of the insulator. In this way, even though a certain amount of carbon is accumulated, the surface of the insulator nose in unlikely to be covered with carbon, thereby enhancing an anti-fouling performance of the spark plug.

However, when the insulator nose is extended, heat is not smoothly transferred from the insulator to the metal shell because the length of a portion of the insulator that is adjacent to the metal shell and that is disposed at a front end side with respect to the plate packing is necessarily reduced. Thus, heat conduction of the insulator is likely to be deteriorated.

Therefore, it is disclosed that the diameter of the front end portion of the insulator is reduced in two levels (i.e., so-called a "double tapered shape") so that an outer circumferential face of a portion between a first step taper portion and a second step taper portion can be close to an inner circumferential face of the metal shell taper portion. See Japanese Patent Application Laid-Open (kokai) No. 2005-183177. Thus, heat can be smoothly transferred from the insulator to the metal shell. As a result, heat conduction of the insulator can be improved, whereby the insulator nose can be further extended.

However, even though the insulator nose is extended, an improvement in anti-fouling performance is not fully achievable compared to a conventional spark plug. In this respect, as shown in FIG. 5, when a region from a front end of the insulator 51 to a location "J", which defines a gap "g" having an equal dimension to that of a spark discharge gap "G" with an inner circumferential face of a metal shell 52, is covered with carbon, a discharge (flashover) tends to occur from the location J into the metal shell 52 due to the carbon. Particularly, when a distance "H" between the front end of the insulator 51 and the location J along an axial C1 is reduced, the front end of the insulator 51 and the location J tends to be covered with carbon, causing flashover. As a result, a normal spark discharge in the spark discharge gap is possibly interrupted.

The present invention addresses the above-described problems. An advantage of the present invention is a spark plug for use in an internal combustion engine that is capable of improving heat conduction, as well as dramatically improving anti-fouling performance of the spark plug.

SUMMARY OF THE INVENTION

Each configuration suitable for solving the above-described problems will be described in each aspect. Any particular effect of the configuration will be described if necessary.

First Aspect.

A spark plug used for internal combustion engines according to a first aspect of the present invention, comprising:

a metal shell including a through hole that extends in an axial direction and a metal convex portion that projects radially inwardly toward the through hole, wherein the metal convex portion is comprised of a convex inner circumferential face having a smallest inner diameter portion, a convex rearward face positioned on the rear end side of the convex inner circumferential face, and a convex forward face positioned on the front end side of the convex inner circumferential face;

an insulator including an axial bore that extends in the axial direction, the insulator also including in its outer circumferential face a first insulator taper portion that is fixed by the convex rearward face of the metal convex portion, a base between the taper portions disposed on the front end side with respect to the first insulator taper portion and facing the convex inner circumferential face in a proximity state, a second insulator taper portion positioned on the front end side with respect to the base between the taper portions and having a contracted outer diameter toward the front end, and an insulator front end portion that extends from the front end of the second insulator taper portion toward the front end side and has a uniform outer diameter or an outer diameter smaller than that of the front end of the second insulator taper portion, wherein a very-end portion of the convex inner circumferential face of the metal convex portion is held by the metal shell so as to face the base between the taper portions;

a center electrode accommodated and held in the axial bore of the insulator;

a ground electrode provided in a front end portion of the metal shell so that a front end portion of the ground electrode faces the front end face of the center electrode, and forms a spark discharge gap with a front end portion of the center electrode, wherein the spark plug satisfies the following:

$$G \leqq (A-B)/2; \quad (1)$$

$$A \leqq 7.3; \quad (2)$$

and $$2 \leqq XX \leqq 4, \quad (3)$$

where "G" (mm) is the spark discharge gap, where "A" (mm) is an inner diameter of the through hole located on a front end side with respect to the convex forward face of the metal convex portion, where "B" (mm) is an outer diameter of a border between the second insulator taper portion and the insulator front end portion, and where "XX" (mm) is a length in the axial direction from a very-end portion of the convex inner circumferential face to the border between the second insulator taper portion and the insulator front end portion.

In addition, the "proximity state" means a state where a gap between the convex inner circumferential face of the metal convex portion and the base between taper portions is relatively small in order to smoothly conduct heat from the insulator to the metal shell. For example, the gap between the convex inner circumferential face and the base between taper portions is preferably less than 0.45 mm. Further, the spark discharge gap may be formed between a noble-metal tip disposed on the front end face of the center electrode and the ground electrode. The noble-metal tip is made of a noble metal, such as, by way of example and not limitation, platinum and iridium. Furthermore, the spark discharge gap may be formed between a noble-metal tip disposed on a portion of the ground electrode that faces the center electrode and the front end face of the center electrode 5, or the noble-metal tip disposed on the center electrode 5.

According to a first aspect of the present invention, the insulator includes a first insulator taper portion, a second insulator taper portion and a base between the taper portions that faces a convex inner circumferential face of a metal convex portion in a proximity state, which is so-called a "double tapered shape". Therefore, heat is efficiently transferred from the base between the taper portions to the convex inner circumferential face of the metal convex portion, and an improvement in heat conduction of the insulator is achievable. Furthermore, by improving heat conduction of the insulator, sufficient heat conduction can be maintained even though the insulator nose of the insulator is extended. As a result, the anti-fouling performance can be improved.

In addition, according to the first aspect, since the representation (1) is satisfied, the gap between the insulator and the metal shell has a dimension equal to that of the spark discharge gap at the rear end side with respect to the border between the second insulator taper portion and the front end portion of the insulator. In this way, the insulator can have a sufficient length in the axial direction (i.e., an "insulating distance in the axial direction") from the front end thereof to the position where the gap between the insulator and the metal shell has the dimension equal to the spark discharge gap G. Thus, flashover is unlikely to occur and stable combustion is facilitated. As a result, a significant improvement in anti-fouling performance is achievable, while extending the insulator nose.

The inner diameter A of the through hole at the front end side with respect to the convex forward face of the metal convex portion is 7.3 mm or more. In this way, the electric current transmitted to the insulator surface is unlikely to be discharged (side spark) to the front end face of the metal shell. Thus, irregular spark discharge can be prevented.

In addition, while the very-end portion of the convex inner circumferential face of the metal convex portion faces the base between the taper portions, the distance XX in the axial direction from the very-end portion of the convex inner circumferential face to the border between the second insulator taper portion and the insulator front end portion is 2 mm or more. Therefore, a space formed between the base end of the insulator front end portion and the inner circumferential face of the metal shell can be made relatively small. As a result, an inflow quantity of the combustion gas to the space can be generally controlled, thereby further improving heat conduction. Moreover, since the distance XX is 4 mm or less, the distance from the center electrode to the metal convex portion along the insulator can be extended relatively long in conjunction with the effect of the "double tapered shape" as described above. Thereby, the anti-fouling performance can be further improved.

In connection with extending the insulation distance relatively long in the axial direction, the thickness of the insulator front end portion is necessary to be made relatively thin. Thus, since high voltage is applied to the center electrode, the withstand voltage performance of the insulator is likely to be deteriorated. However, the base between the taper portions, that has a great influence on the withstand voltage performance, can maintain sufficient thickness because the double tapered shape is adopted. That is, the double tapered shape of the insulator not only contributes improvement in heat conduction, but also prevents a deterioration in the withstand voltage performance.

Second Aspect.

In addition to the first aspect, a spark plug used for internal combustion engine according to a second aspect of the present invention satisfies the following representation:

$$0.8 <= YY <= 2$$

where "YY" (mm) is a thickness of the insulator at the border between the second insulator taper portion and the insulator front end portion.

In order to improve the anti-fouling performance of the spark plug, it is preferable that a gap [(A−B)/2] between the inner circumferential face of the metal shell and the border between the second insulator taper portion and the insulator front end portion be relatively large. In order to widen the gap, the inner diameter of the metal shell can be made relatively large. However, it is not realistic to produce such a spark plug because of the recent demand of a miniaturization (i.e., small diameter) of the spark plug. Thus, the outer diameter of the insulator can be made relatively small. However, when the outer diameter of the insulator is reduced, the withstand voltage performance of the insulator deteriorates, and a discharge (spark penetration) which penetrates the insulator from the center electrode side to the metal shell may occur. Particularly, since a portion from the second insulator taper portion to the insulator front end portion assumes an angular shape, the border, i.e.; junction, between the second insulator taper portion and the insulator front end portion serves as a vertex of the angular shape and is likely to have a high electric field. Thus, the spark penetration is likely to occur at the border, i.e., junction.

According to the second aspect, the thickness YY of the insulator at the border is 0.8 mm or more. Therefore, the withstand voltage performance at the border where the spark penetration tends to occur can fully be improved. Also, the spark penetration can be assuredly prevented.

Further, since the thickness YY of the insulator at the border is 2 mm or less, the gap between the metal shell and the border can be made relatively large. As a result, the metal shell and the insulator are unlikely to be too close to each other, thereby preventing the deterioration in the anti-fouling performance.

Third Aspect.

In addition to the first or the second aspect, a spark plug according to a third aspect of the present invention includes a gap that is equal to the spark discharge gap G where the gap is defined by an inner circumferential face of the through hole at the front end side with respect to the convex forward face of the metal convex portion and a predetermined portion of the second insulator taper portion.

Generally, when the insulator is made into a double tapered shape, a surface area of the second insulator taper portion per unit distance in the axial, direction is larger than that of the insulator front end portion. That is, providing the same amount of carbon exists per unit distance, the second insulator taper portion has a less carbon deposition than the insulator front end portion. Whereby, anti-fouling performance can be improved.

According to the third aspect, the gap defined by the inner diameter A of the through hole at the front end side with respect to the convex forward face of the metal convex portion and the predetermined portion of the second insulator taper portion is equal to the spark discharge gap G. Thus, although the flashover tends to occur at the rear side of the second insulator taper portion with respect to the predetermined portion that has the same dimension as that of the spark discharge gap G, the predetermined portion has a relatively small amount of carbon deposition, whereby the flashover is unlikely to occur. As a result, anti-fouling performance can be further improved.

Fourth Aspect.

In addition to any one of the first to third aspects, a spark plug used for internal combustion engine according to the fourth aspect of the present invention provides a border between the second insulator taper portion and the insulator front end portion, which border is positioned between L/7 and 2L/3 from the base end of the first insulator taper portion, where "L" is a distance from the base end of the first insulator taper portion to the front end of the insulator in the axial direction.

Although the improvement in anti-fouling performance is achievable by extending the insulation distance in the axial direction, it is necessary to reduce a length of the base between the taper portions in the axial direction. Therefore, heat transmission from the insulator to the metal shell is not smoothly performed, whereby it is difficult to maintain sufficient heat conduction performance.

According to the fourth aspect, the border between the second insulator taper portion and the insulator front end portion is positioned between L/7 and 2L/3 from the base end of the first insulator taper portion in the axial direction. Therefore, the insulation distance in the axial direction can be extended relatively long, while sufficiently maintaining the length of the base between the taper portions. As a result, the improvement in anti-fouling performance and heat conduction is achievable in a balanced manner.

Fifth Aspect.

In addition to any one of the first to fourth aspects, a spark plug used for internal combustion engine according to a fifth aspect of the present invention provides an insulator front end portion that has a uniform outer diameter from the base end thereof to at least a position beyond a front end face of the metal shell in the axial direction.

According to the fifth aspect, the insulator front end portion has the uniform outer diameter from the base end of the insulator to at least a position beyond the front end face of the metal shell in the axial direction. Thus, even though the length of the base between the taper portions is modified so as to alter heat conduction (thermal value) of a spark plug, the gap between the front end portion of the metal shell and the insulator is always kept uniform. As a result, it is possible to prevent side sparks due to the reduced gap between the front end portion of the metal shell and the insulator along with the alteration of thermal value.

DETAILED DESCRIPTION OF PREFERRED EMBODIMENTS

Figure 1:
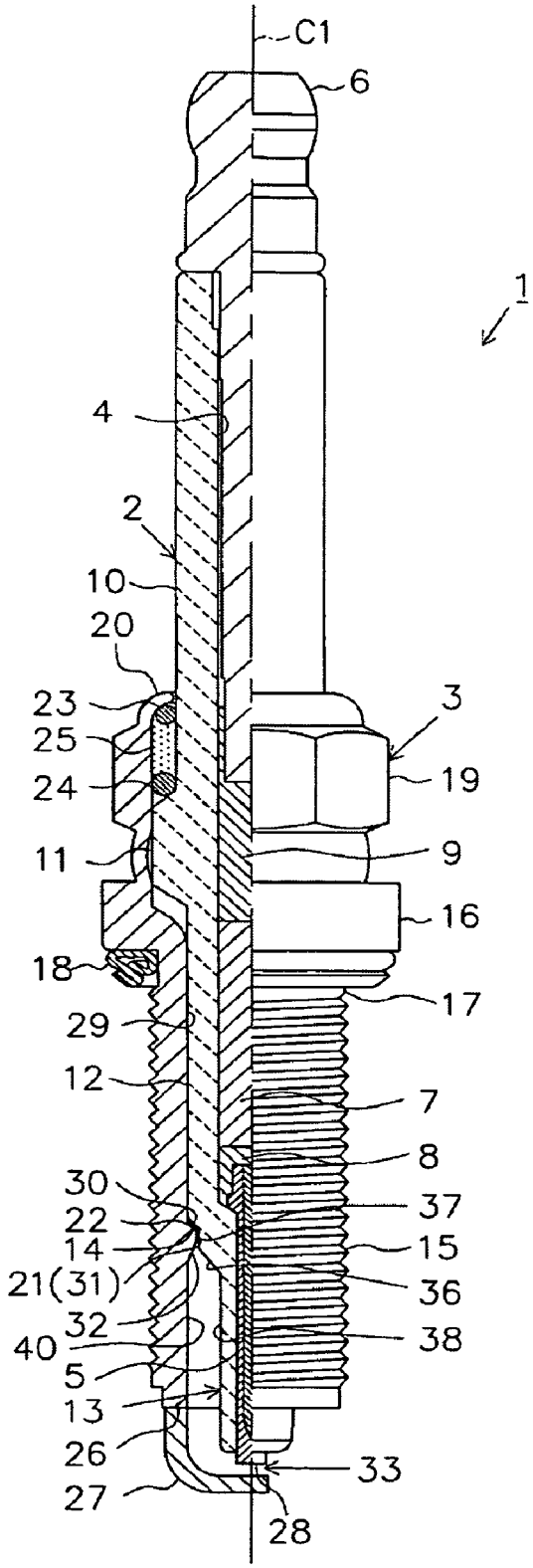
FIG. 1 is a partially sectioned front view of a spark plug according to an embodiment.

An embodiment of the present invention shall now be described with reference to the drawings. FIG. 1 is a partially sectioned, front view showing a spark plug used for combustion engines 1 (hereinafter simply referred to as a "spark plug 1"). In addition, in FIG. 1, a direction of an axis C1 of the spark plug 1 is regarded as the top-to-bottom direction in the drawing. A lower side of the drawing is regarded as a front end side and an upper side of the drawing is regarded as a rear end side of the spark plug 1.

The spark plug 1 is composed of a cylindrical insulator 2 and a cylindrical metal shell 3 that holds the insulator 2 or the like therein.

The insulator 2 has an axial bore 4 extending along the axis C1. A center electrode 5 is inserted and held at a front end side of the axial bore 4, while a terminal electrode 6 is inserted and held at a rear end side thereof. A resistor 7 is disposed between the center electrode 5 and the terminal electrode 6 in the axial bore 4. Both ends of the resistor 7 are electrically connected to the center electrode 5 and the terminal electrode 6, respectively, through conductive glass seal layers 8 and 9. The center electrode 5 projects from and is fixed to the front end of the insulator 2, and the terminal electrode 6 projects from and is fixed to a rear end of the insulator 2.

The insulator 2 is made of sintered alumina or the like as is commonly known. The insulator 2 includes a rear end side body portion 10 formed on the rear end side. A large diameter portion 11 projects radially outwardly at the front end side with respect to the rear end side body portion 10. Insulator 2 further includes a middle body portion 12 having an outer diameter smaller than that of the large diameter portion 11, and an insulator nose 13 having an outer diameter smaller than that of the middle body portion 12. In the insulator 2, the large diameter portion 11, the middle body portion 12 and most of the insulator nose 13 are accommodated in the cylindrical metal shell 3. A taper shaped first insulator taper portion 14 is formed in a connecting portion between the insulator nose 13 and the middle body portion 12 so as to fix the insulator 2 in the metal shell 3. In this embodiment, the length of the insulator nose 13 in the axial direction is longer by a predetermined length (e.g., 1 mm) compared to that of an insulator nose of a conventional spark plug which has the same thermal value (the same heat conduction) as the spark plug 1.

The metal shell 3 is made of a low carbon steel material and has a through hole 29 extending in the axial C1 direction. A thread (male thread) 15 is provided for mounting the spark plug 1 on an engine head. Furthermore, a seat 16 is formed on the outer circumferential face at the rear end side of the thread 15, and a ring-shape gasket 18 is provided on a thread neck 17 formed at the rear end of the thread 15. A hexagonal tool engagement portion 19 is formed at the rear end side of the metal shell 3 for engaging with a tool, such as a wrench, that is used for mounting the metal shell 3 on the engine head.

Further, a caulking portion 20 for holding the insulator 2 is formed at the rear end portion of the metal shell 3.

Further, the through hole 29 of the metal shell 3 has a metal convex portion 21 that projects inwardly radially so as to fix the insulator 2. The metal convex portion 21 includes: a taper-shaped convex rearward face 30 located on the rear end side thereof; a convex inner circumferential face 31 that is located on the front end side of the convex rearward face 30, extending in parallel to the axial C1 and having the smallest uniform inner diameter in the through hole 29; and a convex forward face 32 located on the front end side of the convex inner circumferential face 31 and having a diameter expanding toward the front end. In addition, the through hole 29 has a uniform inner diameter A (best seen in FIG. 2) at a front end side inner circumferential face 40 located on the front end side with respect to the convex forward face 32 of the metal convex portion 21. The insulator 2 is inserted toward the front end side from the rear end side of the metal shell 3 and fixed by radially inwardly caulking an opening portion of the rear end side of the metal shell 3 (i.e., forming the caulking portion 20) while a first insulator taper portion 14 is fixed by the convex rearward face 30 of the metal convex portion 21. Notably, an annular plate packing 22 is disposed between the first insulator taper portion 14 and the convex rearward face 30. In this way, the airtightness in a combustion chamber is maintained, and the air-fuel mixture entering between the insulator nose 13 of the insulator 2 exposed to the combustion chamber and an inner circumferential face of the metal shell 3 is prevented from leaking outside.

Furthermore, in order to make a perfect sealing with caulking, in the rear end side of the metal shell 3, annular rings 23 and 24 are disposed between the metal shell 3 and the insulator 2, and talc powder 25 is filled between the rings 23, 24. That is, the metal shell 3 holds the insulator 2 through the plate packing 22, the rings 23, 24 and the talc 25.

Moreover, a generally L-shaped ground electrode 27 is joined to a front end face 26 of the metal shell 3. A rear end portion of the ground electrode 27 is welded to the front end face 26 of the metal shell 3 and a front end side of the ground electrode is bent so as to face a front end portion 28 of the center electrode 5. A gap is formed between the front end portion 28 of the center electrode 5 and the ground electrode 27, the gap defining a spark discharge gap 33.

Figure 2:
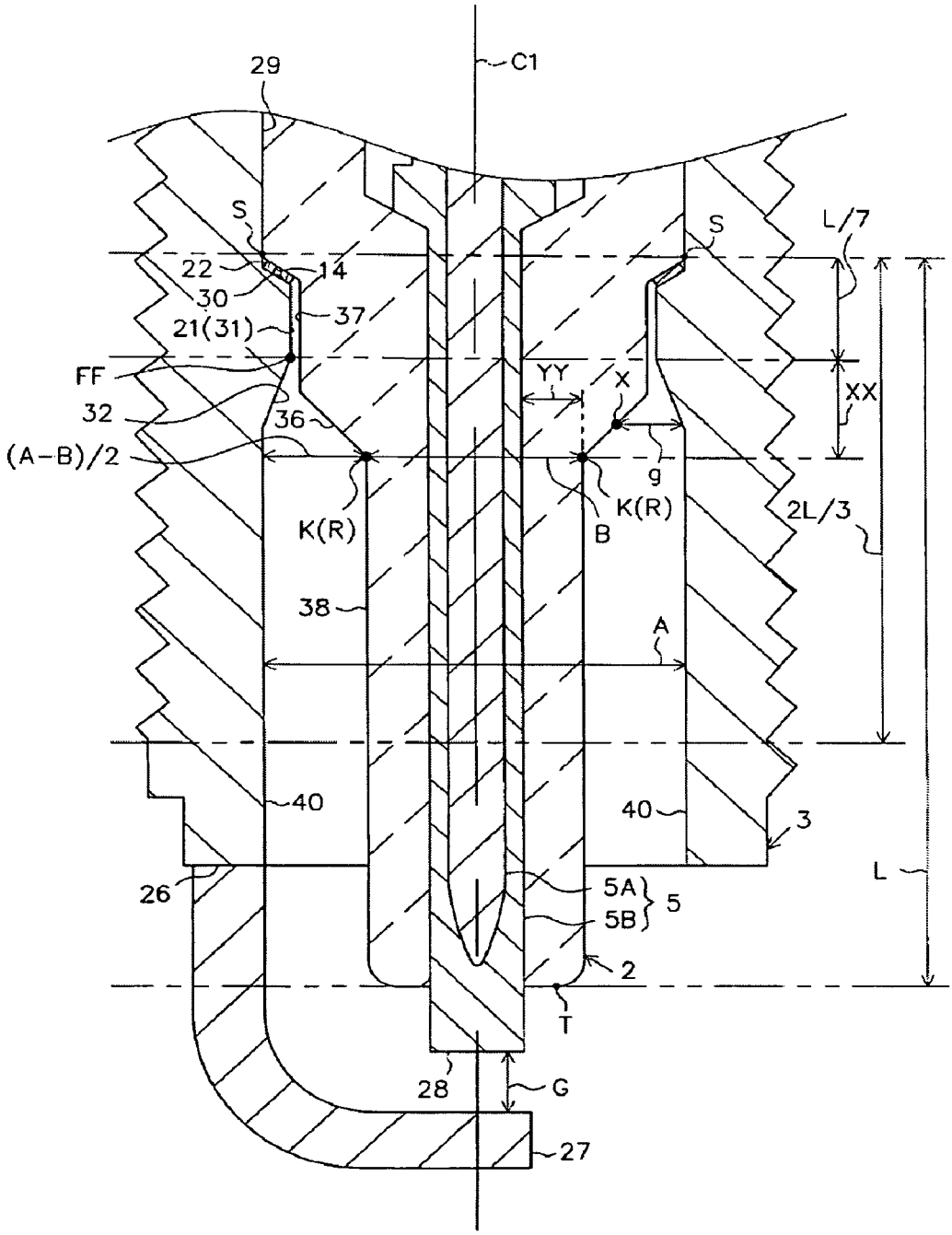
FIG. 2 is a partial expanded sectional view showing a front end portion of the spark plug according to an embodiment.

As shown in FIG. 2, the center electrode 5 is composed of an inner layer 5A made of copper or a copper alloy, and an outer layer 5B made of a nickel (Ni) alloy.

In addition, the insulator 2 assumes a so-called "double tapered shape" in this embodiment. That is, in addition to the first insulator taper portion 14, a base 37 having a uniform outer diameter is formed between the taper portions at a front end side with respect to the first insulator taper portion 14. Further, a taper shaped second insulator taper portion 36 having a reduced diameter toward the front end side is formed at the front end side with respect to the base 37 between the taper portions. Moreover, an insulator front end portion 38 having a smaller diameter than the front end outer diameter of the second insulator taper portion 36 is formed at the front end side with respect to the second insulator taper portion 36. The insulator front end portion 38 has a uniform outer diameter from a base end R to at least a position beyond a front end face 26 of the metal shell 3 in the axial C1 direction. Most of the base 37 between the taper portions closely faces the convex inner circumferential face 31 of the metal convex portion 21 (e.g., a gap therebetween is less than 0.45 mm). Moreover, a very-end portion FF of the convex inner circumferential face 31 faces the base 37 between the taper portions.

Furthermore, in the insulator 2, when a distance from the base end S of the first insulator taper portion 14 to a front end T of the insulator 2 in the axial C1 direction is set to "L", a border (i.e., boundary line) K between the second insulator taper portion 36 and the insulator front end portion 38 is positioned between L/7 and 2L/3 from the base end S of the first insulator taper portion 14 in the axial C1 direction (in a position of L/4 from the base end S of the first insulator taper portion 14 in this embodiment).

The insulator 2 is dimensioned to assume a shape satisfying the following representation (1) $(A-B)/2 \geqq G$, where "G" is a distance of spark discharge gap 33, and where "B" is an outer diameter of the insulator 2 at the border K.

As described the above, the front end side inner circumferential face 40 is made so that the inner diameter A thereof is uniform and the insulator front end portion 38 has the uniform outer diameter from the base end R to at least the front end face 26 of the metal shell 3 in the axial C1 direction. Thus, a gap between the outer circumferential face of the insulator 2 and the inner circumferential face of the through hole 29 is, for the first time, equal to the distance G of the spark discharge gap 33 at the rear end side with respect to the border (i.e., boundary line) K. In detail, in a predetermined region X of the second insulator taper portion 36, a gap "g" between the outer circumferential face of the insulator 2 and the inner circumferential face of the through hole 29 is equal to the distance G of the spark discharge gap 33.

In addition, the inner diameter A of the front end side inner circumferential face 40 is 7.3 mm or more (e.g., 7.5 mm).

Furthermore, a length XX from the very-end portion FF of the convex inner circumferential face 31 to the border (i.e., boundary line) K in the axial C1 direction is 2 mm or more to 4 mm or less.

Further, a thickness YY of the insulator 2 in the border (boundary line) K is set to be 0.8 mm or more to 2 mm or less.

Next, a method for manufacturing the spark plug 1 as described above will be described. First, the metal shell 3 is prepared beforehand. That is, a through hole is formed into a cylindrical metal material (e.g., iron system materials or stainless steel materials, such as S17C and S25C) by cold hammering processing to form a base shape of the metal shell. Then, an outer shape of the metal shell is settled by cutting and grinding process, thereby completing a metal shell intermediate body.

Then, the ground electrode 27 made of Ni alloy (e.g., INCONEL® alloy or the like) is joined to a front end face of the metal shell intermediate body by resistance welding. In the welding process, so-called a "welding droop" tends to be produced. After removing the "welding droop", the thread 15 is formed on the predetermined region of the metal shell intermediate body by rolling process. In this way, the metal shell 3 to which the ground electrode 27 is welded is produced. Zinc plating or nickel plating is applied to the metal shell 3 to which the ground electrode 27 is welded. In addition, chromate treatment can be conducted on the thus-plated surface in order to improve its corrosion resistance.

The insulator 2 is formed separately from the metal shell 3. For example, base powder containing alumina as a principal component and binder are subjected to granulation and the thus-granulated material is subjected to rubber pressing to form a cylindrical green mold body. The thus-formed green mold body is then subjected to cutting and grinding process. Thereafter, the resulting body is fired in a furnace. After firing, the insulator 2 having the first and second taper portions 14, 36 or the like is formed through various grinding processes.

Further, the center electrode 5 is manufactured separately from the metal shell 3 and the insulator 2. That is, Ni alloy is subjected to forging process, and an inner layer 5A made of copper alloy is formed in the center of the center electrode in order to improve heat dissipation.

The thus-formed insulator 2, the center electrode 5, the resistor 7 and the terminal electrode 6 are sealed and fixed with the glass seal layers 8, 9. Generally, the glass seal layers 8, 9 are composed of a mixture of borosilicate glass and metal powder, and the mixture is filled in the axial bore 4 of the insulator 2 so as to sandwich the resistor 7. After that, the terminal electrode 6 is pressed into the axial bore 4 from the rear side, and the assembly is fired in the furnace. In addition, at this time, a glaze layer may be formed simultaneously with the firing on a surface of the rear end side body portion 10 of the insulator 2, or may be formed in advance.

Then, the thus-formed center electrode 5, the insulator 2 having the terminal electrode 6 and the metal shell having the ground electrode 27 are assembled. More particularly, the rear end side opening portion of the metal shell 3, which has relatively a thin thickness, is radially inwardly caulked. That is, the caulking portion 20 is formed to fix the center electrode 5, the insulator and the metal shell 3.

Finally, the spark discharge gap 33 formed between the front end portion 28 of the center electrode 5 and the ground electrode 27 is adjusted by bending the ground electrode 27.

In this way, the spark plug 1 having the above-described configuration is manufactured through a series of these processes.

Figure 3:
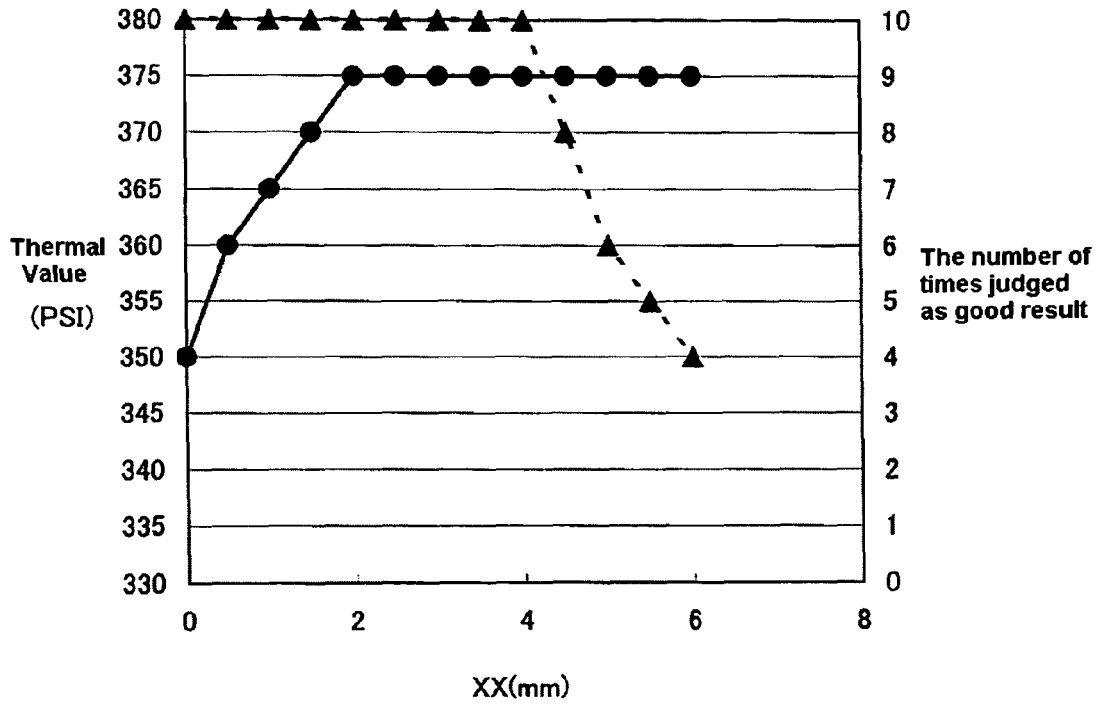
FIG. 3 is a graph showing results of a thermal value measurement test and an anti-fouling performance test.

Next, in order to confirm the effects of the spark plug 1 having the above-described configuration according to the embodiment, the following tests were conducted. Samples of a spark plug were produced for an anti-fouling test and a thermal value measurement test. The samples had the thread 15 with an outer diameter of M12 and the length XX in the axial C1 direction from the very-end portion FF of the convex inner circumferential face 31 to the border (boundary line) K between the second insulator taper portion 36 and the insulator front end portion 38. In the anti-fouling test, a test car where four spark plugs were mounted on each cylinder of a 4-cylinder engine (1800 cc displacement), respectively, is located on a chassis dynamometer in a low-temperature-test room (at −10 degrees C.). However, insulation resistance value between the metal shell 3 and the insulator 2 at an early stage was so large that it was not measurable. After pressing down on an accelerator for 3 times, the test car ran for 40 seconds at 35 km/h with the 3rd gear, and again ran for 40 seconds at 35 km/h with the 3rd gear following the idling for 90 seconds. Thereafter, the engine was stopped for cooling down. Subsequently, the test car ran for 20 seconds at 15 km/h with the first gear after pressing down on the accelerator for 3 times and the engine was stopped for 30 seconds. The same procedure was conducted in total 3 times. These series of test pattern was counted as one cycle, and 10 cycles were conducted for the test. The number of times (number of times judged as good result) that the insulation resistance value was over 100 M ohm was measured at each time when finishing the cycle. The thermal value measurement test was conducted based on the SAE specification. The outline of this test is as follows. The samples were mounted on an SC17.6 (SAE J2203) engine, and the timing was set at 30 degrees BTDC with the compression ratio of 5.6. The engine ran at 2700 rpm using a fuel mainly containing benzole and a certain amount of air that was supercharged. Based on an amount of supercharged air, an amount of fuel injection was adjusted so that the combustion chamber could reach at the highest temperature. Increase in the supercharge amount and adjustment of the fuel injection amount were repeatedly conducted so that a supercharge pressure just before pre-ignition could be determined. Thereafter, the thus-defined supercharge pressure was finely adjusted, and also the amount of fuel injection was adjusted so as to measure the engine power when the engine was stably operated for 3 minutes. Also, a mean effective pressure (PSI) was calculated and defined as a thermal value of each sample. FIG. 3 shows a relationship between the length XX, the number of times judged as good result and the thermal value. In this figure, the number of times judged as good result is indicated with black triangles and the thermal value is indicated with black dots.

As shown in FIG. 3, the sample having the length XX of 2 mm or more exhibited an increase in the mean effective pressure and improved heat conduction. Since a space formed between the base end portion of the insulator front end portion 38 and the inner circumferential face of the metal shell 3 was relatively small, the quantity of combustion gas inflow to the space was generally controlled.

Further, the sample having the length XX of 4 mm or less exhibited an outstanding anti-fouling performance, showing 10 good results. This was because the distance from the center electrode 5 to the metal convex portion 21 along the insulator 2 became relatively wide when the length XX was 4 mm or less.

As described above, in light of improving both the heat conduction and the anti-fouling performance, it is preferable that the length XX in the axial C1 direction from the very-end portion FF of the convex inner circumferential face 31 to the border (boundary line) K between the second insulator taper portion 36 and the insulator front end portion 38 be 2 mm or more to 4 mm or less.

Next, a plurality of insulator 2 samples were produced for withstand voltage test. Each sample had a different thickness YY of the border K (border thickness) between the second insulator taper portion 36 and the insulator front end portion 38. The center electrode 5 was provided in the insulator 2. The results of the withstand voltage test is as follows. A front end of a ground having an apical angle of 30 degrees was disposed at 2 mm radially outwardly apart from the surface of the second insulator taper portion 36. Then, a voltage of 25 kV was applied to the center electrode 5 for 1 minute to determine whether or not the discharge (penetration discharge) occurred between the center electrode 5 and the ground that penetrates the insulator 2. The samples exhibited no penetration are indicated as "○" meaning an excellent withstand voltage, while the samples exhibited the penetration are indicated as "X" meaning insufficient withstand voltage.

Furthermore, a plurality of spark plug samples was produced for anti-fouling test. The spark plug is equipped with the insulator 2 each having various thicknesses YY of the border K. Each sample was subjected to the above-described anti-fouling test at the low-temperature-test room of −20 degree C. The number of times judged as good result was counted. In addition, the thread 15 of each sample was M12. Table 1 shows the border thickness YY, the results of the withstand voltage performance and the number of times judged as good result.

TABLE 1

| Border Thickness (mm) | Withstand Voltage Test | Number of Good Results |
|---|---|---|
| 0.2 | x | 10 |
| 0.4 | x | 10 |
| 0.6 | x | 10 |

TABLE 1-continued

| Border Thickness (mm) | Withstand Voltage Test | Number of Good Results |
|---|---|---|
| 0.8 | ○ | 10 |
| 1 | ○ | 10 |
| 1.2 | ○ | 10 |
| 1.4 | ○ | 10 |
| 1.6 | ○ | 10 |
| 1.8 | ○ | 10 |
| 2 | ○ | 10 |
| 2.2 | ○ | 9 |
| 2.4 | ○ | 8 |
| 2.6 | ○ | 7 |
| 2.8 | ○ | 5 |
| 3 | ○ | 5 |

As shown in Table 1, the samples having the border thickness YY of 0.8 mm or more did not exhibit the penetration discharge. This was because the thickness YY of the border (boundary line) K had an enough thickness to bear the high voltage. Further, the samples having the border thickness YY of 2 mm or less exhibited 10 good results, showing the excellent anti-fouling performance. This was because the space between the metal shell 3 and the border (boundary line) K was kept relatively wide.

As described above, both the withstand voltage performance and anti-fouling performance can be improved by maintaining the border thickness YY to be 0.8 mm or more to 2 mm or less.

Further, in the spark plug 1 according to this embodiment, since the inner diameter A of the front end side inner circumferential face 40 is 7.3 mm or more, a side spark generated in the gap between the front end portion of the metal shell 3 and the insulator 2 can be further prevented.

In addition, the border (boundary line) K between the second insulator taper portion 36 and the insulator front end portion 38 is positioned between L/7 and 2L/3 from the base end S of the first insulator taper portion 14 in the axial C1 direction. In this way, the insulation distance in the axial direction can be relatively extended, and the sufficient distance in the axial direction of the base 37 between the taper portions can also be maintained. As a result, the improvement in both the anti-fouling performance and the heat conduction is achievable with sufficient balance.

Further, since the insulator front end portion 38 has a uniform outer diameter to at least a position beyond the front end face 26 of the metal shell 3 in the axial C1 direction, the gap between the front end portion of the metal shell 3 and the insulator 2 can always be uniform. Therefore, a side spark due to change in thermal value is unlikely to occur.

In addition, the present invention is not particularly limited to the embodiments described above but may be changed or modified in various ways within the scope of the invention. For example, the present invention may carry out as follows.

Figure 4:
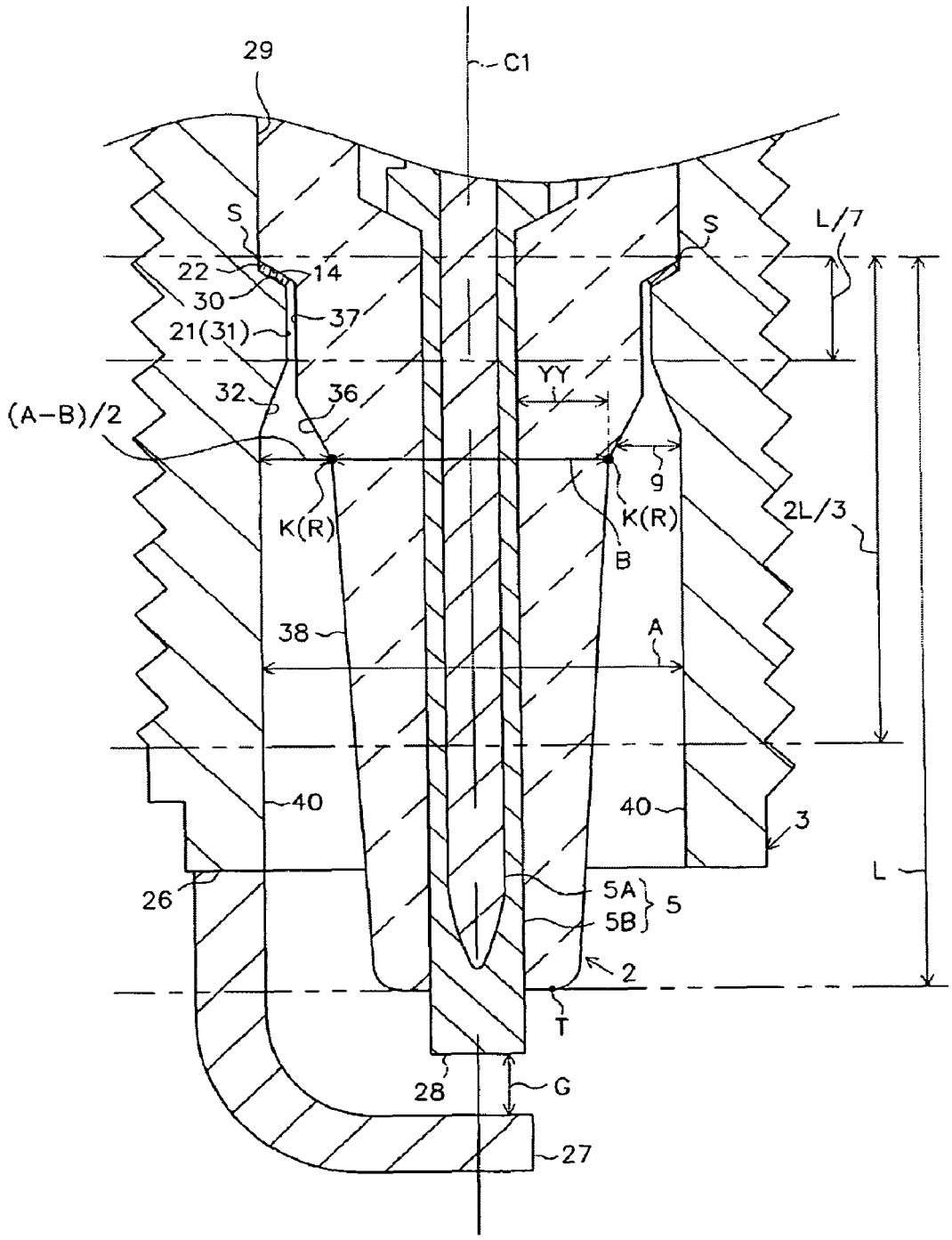
FIG. 4 is a partially expanded sectional view showing a front end portion of a spark plug according to another embodiment.
Figure 5:
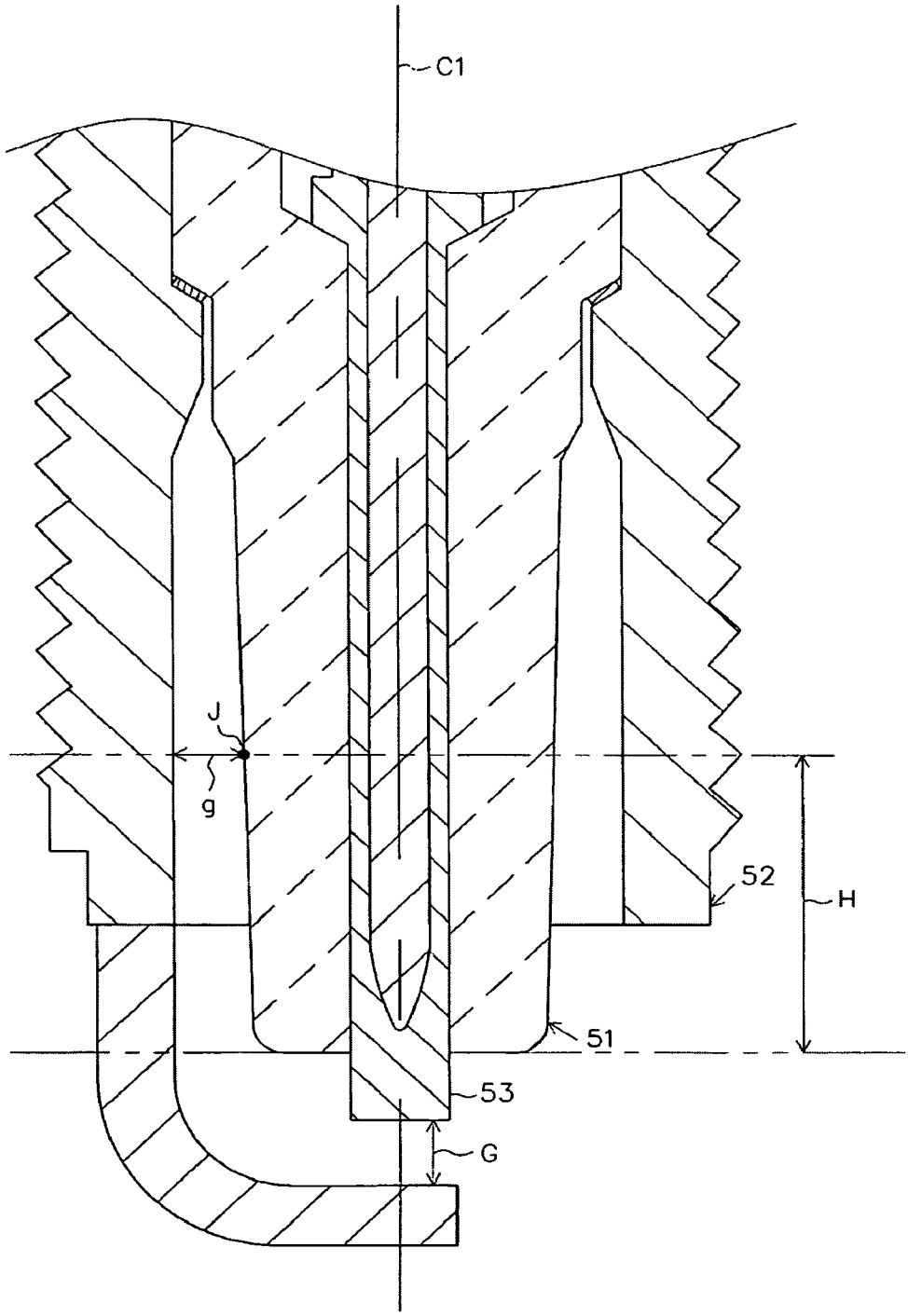
FIG. 5 is a partially expanded sectional view showing a front end portion of a conventional spark plug.

(a) In the above-described embodiment, the insulator front end portion 38 has a uniform outer diameter from the base end R thereof to at least the position beyond the front end face 26 of the metal shell 3 in the axial C1 direction. However, as shown in FIG. 4, the insulator front end portion 38 can be tapered off toward the front end.

(b) Although the spark discharge gap 33 is formed between the front end portion 28 of the center electrode 5 and the ground electrode 27 in the above-described embodiment, it may be formed between a noble-metal tip on the front end portion 28 of the center electrode 5 and the ground electrode 27. The noble-metal tip is made of a noble metal, such as platinum and iridium. On the other hand, the spark discharge gap 33 may be formed between a noble-metal tip on the ground electrode 27 at a position facing the center electrode 5 and the front end portion 28 of the center electrode 5, or a noble-metal tip on the center electrode 5.

(c) In the above-described embodiment, although the center electrode 5 has the two-layer structure composed of the inner layer 5A and the outer layer 5B, it may be composed of a single layer. Further, the center electrode 5 may have the outer layer 5B only in the front end portion thereof, and other portion thereof where no outer layer 5B is provided may have a side face where the inner layer 5A is exposed to the outer circumferential face of the center electrode 5. Furthermore, although the outer layer 5B is made of Ni alloy, it may be made of an iron alloy that chromium, aluminum or the like is added to iron.

(d) In the above-described embodiment, the ground electrode 27 is joined to the front end of metal shell 3. However, the present invention is applicable to the case where the ground electrode is formed from a part of the metal shell (or a part of a front end metal welded to the metal shell in advance) that is ground (e.g., JP, 2006-236906,A).

(e) According to the above-described embodiment, although the tool engagement portion 19 assumes the hexagonal shape in the cross-section, it is not limited to such shape. For example, the tool engagement portion 19 may assume a Bi-HEX (modified dodecagon) shape [ISO22977: 2005 (E)] or the like.

The invention claimed is:

1. A spark plug used for internal combustion engines, comprising:

a metal shell having a front end, a rear end and a through hole that extends from said front end to said rear end in an axial direction along an axis of said through hole, said metal shell having a metal convex portion that projects radially inwardly toward the axis of the through hole, the metal convex portion having a convex inner circumferential face having a smallest inner diameter portion, a convex rearward face positioned on the rear end side of the convex inner circumferential face, and a convex forward face positioned on the front end side of the convex inner circumferential face;

an insulator having a front end, a rear end and an axial bore that extends in the axial direction, the insulator having an outer circumferential face, said circumferential face having a first insulator taper portion that is fixed relative to said metal shell by the convex rearward face of the metal convex portion, a base portion disposed toward the front end side of the insulator relative to the first insulator taper portion and adjacent the convex inner circumferential face of said metal shell, a second insulator taper portion disposed toward the front end side of the insulator relative to the base said second insulator taper portion having an outer diameter that contracts toward the front end of said insulator, and an insulator front end portion that extends from the second insulator taper portion toward the front end side of said insulator and has a uniform outer diameter or an outer diameter smaller than that of the front end of the second insulator taper portion, wherein a very-end portion of the convex inner circumferential face of the metal convex portion is held by the metal shell so as to face the base portion of said insulator;

a center electrode disposed and held in the axial bore of the insulator;

a ground electrode provided on a front end portion of the metal shell wherein a front end portion of the ground electrode faces the front end face of the center electrode, said front end portion of said ground electrode forming a spark discharge gap with a front end portion of the center electrode, wherein the spark plug satisfies the following representations (1) to (3), $$G \leqq (A-B)/2; \quad (1)$$

$$A \geqq 7.3; \quad (2)$$

and $$2 \leqq XX \leqq 4, \quad (3)$$

where "G" (mm) is the spark discharge gap, where "A" (mm) is an inner diameter of the through hole of the metal shell taken at a location on a front end side relative to the convex forward face of the metal convex portion, where "B" (mm) is an outer diameter taken where the second insulator taper portion communicates with the insulator front end portion, and where "XX" (mm) is a length in the axial direction from a very-end portion of the convex inner circumferential face to the border between the second insulator taper portion and the insulator front end portion.

2. The spark plug used for internal combustion engine according to claim 1 satisfies the following representation:

$$8 <= YY <= 2$$

where "YY" (mm) is a thickness of the insulator at the location where the second insulator taper portion communicates with the insulator front end portion.

3. The spark plug according to claim 1 or 2, wherein a gap defined between an inner circumferential face of the through hole at the front end side with respect to the convex forward face of the metal convex portion and a predetermined portion of the second insulator taper portion is equal to the spark discharge gap G.

4. The spark plug used for internal combustion engine according to claim 1 or 2, wherein the location where the second insulator taper portion communicates with the insulator front end portion is positioned between L/7 and 2L/3 from the base end of the first insulator taper portion, where "L" is a distance from the base end of the first insulator taper portion to the front end of the insulator in the axial direction.

5. The spark plug used for internal combustion engine according to claim 1 or 2, wherein the insulator front end portion has a uniform outer diameter from the base end thereof to at least a position beyond a front end face of the metal shell in the axial direction.

* * * * *